US009115894B1

(12) United States Patent
Mann

(10) Patent No.: US 9,115,894 B1
(45) Date of Patent: Aug. 25, 2015

(54) TWO-CHAMBER EDUCTOR BASED INCINERATOR WITH EXHAUST GAS RECIRCULATION

(71) Applicant: James R. Mann, Damascus, MD (US)

(72) Inventor: James R. Mann, Damascus, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 433 days.

(21) Appl. No.: 13/781,814

(22) Filed: Mar. 1, 2013

(51) Int. Cl.

| | |
|---|---|
| ***F23B 10/02*** | (2011.01) |
| ***F23G 5/027*** | (2006.01) |
| ***F23G 5/16*** | (2006.01) |
| ***F23N 1/02*** | (2006.01) |
| ***F23G 5/50*** | (2006.01) |
| ***F23G 5/38*** | (2006.01) |
| ***F23B 30/00*** | (2006.01) |
| ***F23B 90/04*** | (2011.01) |

(52) U.S. Cl.
CPC ... *F23G 5/16* (2013.01); *F23B 5/04* (2013.01); *F23B 10/02* (2013.01); *F23B 90/04* (2013.01); *F23G 5/0276* (2013.01); *F23G 5/38* (2013.01); *F23G 5/50* (2013.01); *F23G 2201/40* (2013.01); *F23G 2202/102* (2013.01); *F23G 2202/103* (2013.01); *F23N 1/025* (2013.01)

(58) Field of Classification Search
CPC ..... F23B 5/04; F23B 10/00; F23B 10/02; F23B 90/04; F23G 5/027; F23G 5/0276; F23G 5/14; F23G 5/16; F23G 2201/40; F23G 2202/10; F23G 2202/101; F23G 2202/102; F23G 2202/103
See application file for complete search history.

(56) References Cited

U.S. PATENT DOCUMENTS

| | | | | |
|---|---|---|---|---|
| 4,098,200 | A | 7/1978 | Dauvergne | |
| 4,167,909 | A * | 9/1979 | Dauvergne | 110/207 |
| 5,156,098 | A | 10/1992 | Camp | |
| 5,158,025 | A * | 10/1992 | Johnson | 110/235 |
| 5,163,829 | A | 11/1992 | Wildenberg | |
| 6,343,500 | B1 | 2/2002 | Katogi et al. | |
| 7,503,178 | B2 | 3/2009 | Bucker et al. | |
| 7,674,947 | B2 | 3/2010 | Barends | |
| 2003/0221597 | A1 * | 12/2003 | Barba | 110/342 |

* cited by examiner

*Primary Examiner* — David J Laux
(74) *Attorney, Agent, or Firm* — Dave A. Ghatt

(57) ABSTRACT

The invention is directed to an optimized two-chamber eductor based incinerator system. The two-chamber optimized incinerator system includes a primary and a secondary combustion chamber, the system having a single fuel fired burner located in one of the secondary combustion chamber, or the eductor. The system also includes an eductor connecting the primary combustion chamber to the secondary combustion chamber, the eductor creating a recirculation flow through the first and the second combustion chambers.

10 Claims, 3 Drawing Sheets

TWO-CHAMBER EDUCTOR BASED INCINERATOR WITH EXHAUST GAS RECIRCULATION

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to an optimized eductor based incinerator, more particularly, an optimized incinerator system having first and second combustion chambers having a single fuel fired burner for facilitating combustion in both the first and the second combustion chambers by utilizing an exhaust gas recirculation flow through the first and the second combustion chambers.

BACKGROUND

Generally speaking, an incinerator is essentially a combination of a furnace and a chemical process system with the primary purpose of waste destruction and volume reduction. A traditional two chamber incinerator has a fuel fired burner and a combustion air blower for each chamber. The solid or liquid waste is reacted with oxygen to turn it onto a fuel gas in the primary combustion chamber. The fuel gas is mixed with additional air in a secondary combustion chamber and reacted to form exhaust gas.

Fuel fired burners are used to preheat the chambers. The fuel fired burner in the second combustion chamber is usually operated at all times to maintain the temperature of that chamber and to provide an ignition source for the fuel gas entering from the primary combustion chamber. The fuel fired burner for the primary combustion chamber is usually turned off once the solid or liquid waste begins reacting and gives off heat. The amount of combustion air that enters the two chambers also controls the rate of the reactions. Although this allows good control of the system temperatures, it requires two separate burners and two blowers. In a few instances, the prior art teaches two-chamber arrangements having a single burner. In these prior art teachings, the heat from on chamber is used to ignite the other combustion chamber, via conduction through the walls of the combustion chambers. There is a loss of efficiency due to the heating via conduction. Thus, it is desired to have a more efficient two-chamber incinerator having a single burner for providing combustion in both chambers.

SUMMARY

In one aspect, the invention is a two-chamber incinerator system. The system includes a primary combustion chamber having a combustion bed for receiving waste. The system also includes a primary combustion air source connected to the primary combustion chamber providing a primary combustion air supply into the primary combustion chamber. The system also includes a secondary combustion chamber, downstream of the primary combustion chamber, and an eductor attached to an inlet region of the secondary combustion chamber. According to this aspect, the system also includes a fuel source connected to the eductor providing fuel into the secondary combustion chamber, and a secondary combustion air source connected to the secondary combustion chamber providing a secondary combustion air supply into the secondary combustion chamber. The system further includes a burner in one of, the secondary combustion chamber or the eductor for igniting the fuel in the secondary chamber. The two-chamber incinerator system also has an exhaust fuel-gas conduit, connecting the primary combustion chamber to the eductor, the exhaust fuel-gas conduit feeding fuel-gas from the primary combustion chamber to the secondary combustion chamber. The system further includes an exhaust gas conduit, connecting the secondary combustion chamber to the primary combustion chamber, wherein the exhaust gas conduit feeds exhaust gas from the secondary combustion chamber to the primary combustion chamber, the exhaust gas, in combination with the primary combustion air, igniting the waste within the primary combustion chamber, wherein the fuel-gas conduit and the exhaust gas conduit form a recirculation loop between the primary combustion chamber and the secondary combustion chamber.

In another aspect, the invention is a method of waste combustion. The method includes, providing a primary combustion chamber having a combustion bed for receiving waste therewithin, providing waste on the combustion bed, and providing a primary combustion air source connected to the primary combustion chamber providing a primary combustion air supply into the primary combustion chamber. The method also includes providing a secondary combustion chamber, downstream of the primary combustion chamber, providing an eductor attached to an inlet region of the secondary combustion chamber, and providing a fuel source connected to the eductor providing fuel into the secondary combustion chamber. In this aspect, the method also includes, providing a secondary combustion air source connected to the eductor providing a secondary combustion air supply into the secondary combustion chamber, providing a burner in one of the secondary combustion chamber or the eductor, for igniting the fuel, providing an exhaust fuel-gas conduit, connecting the primary combustion chamber to the eductor, and providing an exhaust gas conduit, connecting the secondary combustion chamber to the primary combustion chamber. In this aspect, the method of waste combustion also includes, feeding combustion air from the secondary combustion air source into the secondary combustion, feeding fuel into the secondary combustion chamber, igniting the burner to burn the fuel thereby creating an exhaust gas byproduct within the secondary combustion chamber directing the exhaust gas to the primary combustion chamber via the exhaust gas conduit, and using the exhaust gas waste in combination with the primary combustion air supply to ignite the waste within the combustion bed.

BRIEF DESCRIPTION OF THE DRAWINGS

Other features will be apparent from the description, the drawings, and the claims.

DETAILED DESCRIPTION

Figure 1:
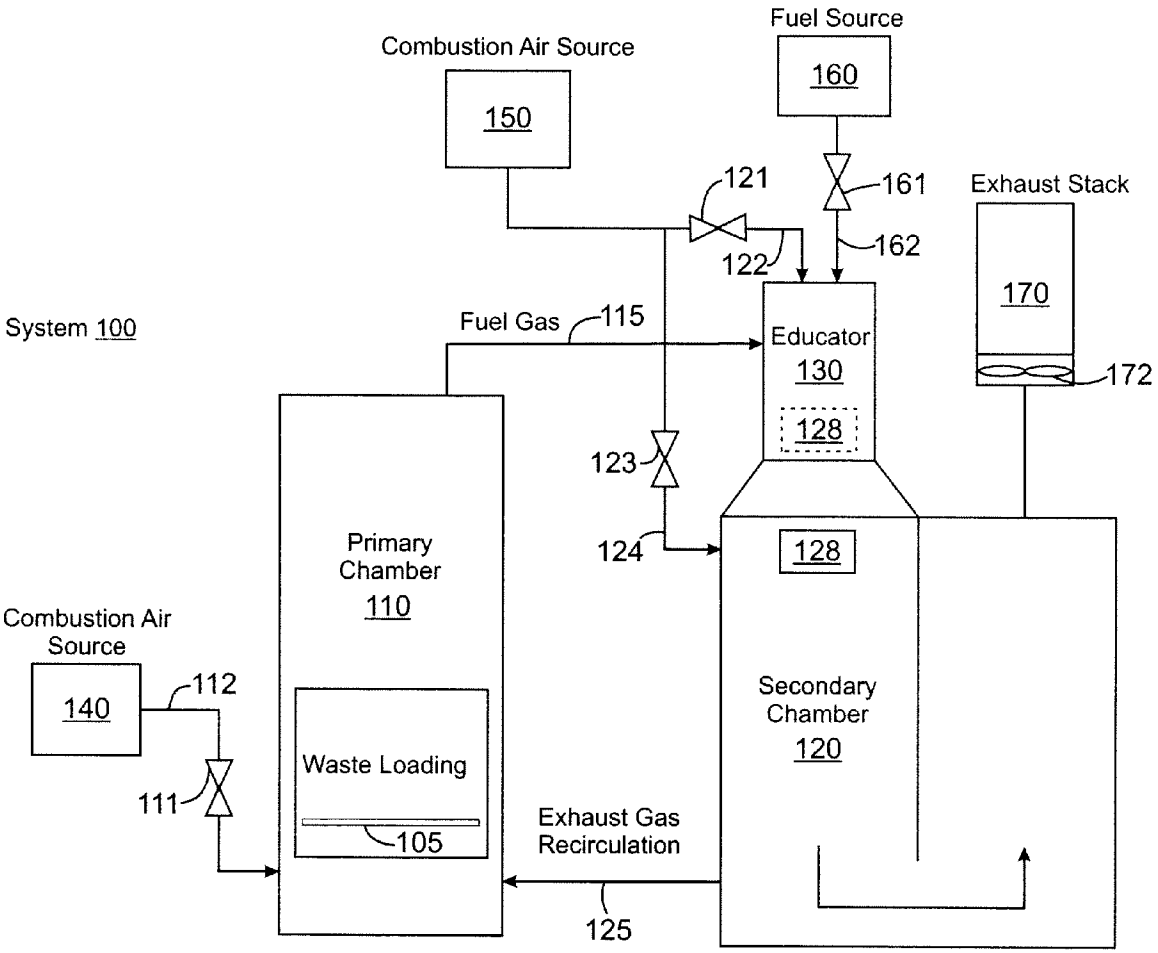
FIG. 1 is an exemplary schematic illustration of a two-chamber eductor based incinerator system with exhaust gas recirculation, according to an embodiment of the invention.

FIG. 1 is an exemplary schematic illustration of a two-chamber incinerator system 100. As outlined below, the two-chamber incinerator system 100 is an eductor-based system with exhaust gas recirculation. FIG. 1 shows the incinerator system 100 having a primary combustion chamber 110. The combustion chamber 110 includes a waste loading area such as a combustion bed 105 for receiving waste thereon. As shown, a combustion air source 140 having combustion air is connected to combustion chamber 110, via a conduit 112. FIG. 1 also shows a valve 111 for regulating the flow of combustion gas into the combustion chamber 110. The combustion air may typically be any mixture having an appropriate amount of oxygen, such as 21% or more.

FIG. 1 also shows a secondary combustion chamber 120 downstream from the primary combustion chamber 110. Also illustrated is an eductor 130, which is connected at an inlet area of the secondary combustion chamber 120. As shown, a combustion air source 150 having combustion air is connected to eductor 130 via a conduit 122. FIG. 1 also shows a secondary valve 121 for regulating the flow of combustion gas into the secondary combustion chamber 120 via the eductor 130. As shown, the system also includes a bypass combustion air conduit 124 with an accompanying bypass valve 123 for feeding combustion air directly into the secondary combustion chamber 120. FIG. 1 also shows a fuel source 160 connected to the eductor 130 via a conduit 162, the fuel source 160 providing fuel into the secondary combustion chamber 120 via the eductor 130. As outlined below, the fuel and the combustion gas are ignited by a burner 128, positioned within the secondary chamber 120. As stated above the combustion air may typically be any mixture having an appropriate amount of oxygen, such as 21% or more. The fuel may be liquid or gaseous, such as fuel oil, diesel, or natural gas for example. As outlined below, by supplying the combustion air and the fuel into the secondary combustion chamber 120 through the eductor 130, a pressure differential is produced which initiates recirculation throughout the combustion system 100.

As shown in FIG. 1, a fuel-gas conduit 115 connects the primary combustion chamber 110 to the secondary combustion chamber 120 via the eductor 130. The fuel-gas conduit 115 is attached directly to the primary combustion chamber 110 and feeds the fuel-gas output from the primary chamber 110, through the eductor 130 at reduced pressure, into the secondary combustion chamber 120. As shown, the combustion system 100 also includes an exhaust gas recirculation conduit 125 connecting the secondary combustion chamber 120 to the primary combustion chamber 110, for circulating a portion of the exhaust gas from the secondary combustion chamber 120 into the primary combustion chamber 110. The combustion system 100 also includes an exhaust stack arrangement 170 through which the balance of the exhaust gas exits the combustion system 100. As shown, the exhaust stack arrangement 170 may optionally include a fan 172 to assist with the evacuating of the exhaust gas through the stack 170. As outlined below, during the operation of the combustion system 100, pressure differences in the secondary combustion chamber 120 causes a portion of the exhaust to flow to the primary chamber 110 and a portion to flow to the exhaust stack arrangement 170. It should be noted that FIG. 1 is a schematic illustration, showing important elements of the invention. Consequently, all elements are not illustrated. Thus for example, the system 100 may also include more complex conduit components, including waste and ash conveying equipment, pumps, valves, conveyors, filters, etc., that are not illustrated.

Figure 2:
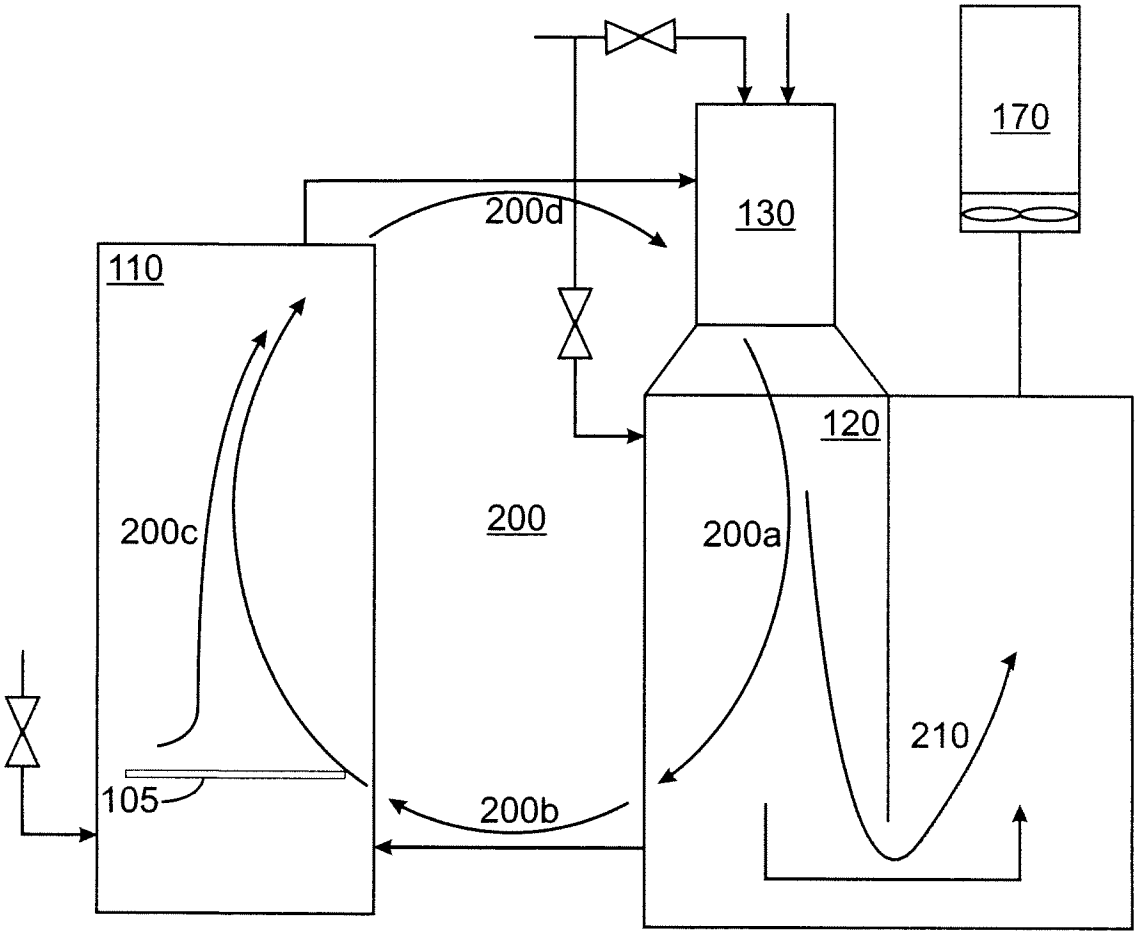
FIG. 2 is an exemplary schematic illustration of a two-chamber eductor based incinerator system, showing the recirculation loop and exhaust flow, according to an embodiment of the invention.

FIG. 2 is an exemplary schematic illustration of an eductor based incinerator system 100, showing the recirculation loop 200 (200*a*, 200*b*, 200*c*, 200*d*) and exhaust flow 210, according to an embodiment of the invention. As outlined above, the two-chamber incinerator system 100 includes only one burner 128 located in the secondary combustion chamber 120. As illustrated in FIG. 1 in dotted lines, the one burner 128 may also be located within the eductor 130. As outlined below, the use of only the single burner 128 is facilitated by the ability of the system 100 to maintain the flow in the recirculation loop 200 during operations, with high temperature exhaust gas from the secondary combustion chamber 120 providing the necessary heat to ignite and oxidize the waste in the primary combustion chamber 110. The two-chamber incinerator system 100 also has the additional benefit of using no fans or only one fan 172 at the exhaust stack arrangement 170.

According to an embodiment of the invention, the two-chamber incinerator system may be operated in the following manner. Waste is loaded in the combustion bed 105 in the primary combustion chamber 110. The secondary combustion chamber 120 is then preheated to a predetermined preheat temperature of about 1,800 to about 2,000 degrees Fahrenheit This preheating process is performed by feeding fuel and combustion air into the secondary combustion chamber 120. The fuel is fed via the fuel source 160 via a fuel valve 161. The fuel and the combustion air react when the burner 128 is turned on. During this preheating phase, the combustion air is fed into the chamber 120 via the bypass conduit 124 by opening the bypass valve 123. Feeding the combustion air via the bypass conduit 124 and not through the eductor 130 avoids the pressure rise associated with the eductor 130 that would prematurely trigger the full recirculation shown in FIG. 2.

When the secondary combustion chamber 120 reaches the predetermined preheat temperature, the source of the combustion air is switched from the bypass conduit 124 to the secondary combustion air source conduit 122 by closing the bypass valve 123 and opening the secondary combustion air valve 121. The predetermined preheat temperature may be about 1,800 to about 2,000 degrees Fahrenheit. The rate at which the fuel is supplied to the secondary combustion chamber 120 may be reduced to the extent that the predetermined preheat temperature is substantially maintained. The flow of combustion air through the eductor 130 causes a pressure difference across the eductor 130 with a higher pressure at the exit of the eductor, which is inside the secondary combustion chamber 120, and a lower pressure at the eductor inlet, which is at the exit of the primary combustion chamber 110. This is achieved because of the operation of the eductor 130. Within the eductor 130, there is a high velocity flow (the secondary combustion air from conduit 122) and a low velocity flow (the fuel gas from primary chamber 110) that mix in a mixing chamber within the eductor. The momentum of the high velocity secondary combustion air plus the momentum of the low velocity fuel gas is equal to the momentum of the mixed gases. According to design, the mixing chamber within the eductor 130 expands in cross section and the velocity of the mixed gas is reduced and its pressure increases ("Bernoulli's principle"). The mixed gases enter the secondary combustion chamber 120 at a higher pressure than the mixing section and the primary combustion chamber 110. This pressure rise provides the forces needed to cause recirculation of the gases, as described below.

This pressure difference, as outlined above, precipitates the recirculation loop 200 (200*a*, 200*b*, 200*c*, 200*d*) shown in FIG. 2, starting with the hot exhaust from the secondary combustion chamber 120 flowing into the primary combustion chamber 110, via the exhaust gas recirculation conduit 125. Due to the continued pressure differences, the exhaust gas moves through the primary combustion chamber 110, through the fuel gas conduit 115, through the eductor 130 and back into the secondary combustion chamber 120.

It should also be noted that according to the invention, in the primary combustion chamber 110, the high temperature exhaust gas transmitted through exhaust gas conduit 125 in combination with combustion air from source 140, is used to ignite and partially oxidize the waste in the combustion bed 105 of the primary combustion chamber 110. Thus, as the exhaust air enters the primary chamber (as shown at 200*b*) combustion air is fed into the primary combustion chamber 110 by opening the valve 111. According to the invention, no burner is required to ignite the waste because the ignition is provided by the hot exhaust air cycled from the secondary combustion chamber 120. As the waste is ignited and oxidized, the volatile components of the waste join the exhaust gas (shown by the double-arrows in the loop section 200*c*) exiting the primary combustion chamber 110 as a fuel-gas exhaust mixture (shown in the loop section 200*d*). As the combustion process continues, so does the recirculation loop 200.

When the temperature of the primary chamber reaches its set point (approximately 1600 degrees Fahrenheit), the exhaust flow 200*b* is no longer required. The combustion air bypass valve 123 is opened and the combustion air valve 121 is closed, causing the combustion air to enter via conduit 124, bypass the eductor, eliminate the pressure rise in the eductor, and stop the recirculating exhaust flow 200. After both chambers have reached their operating temperatures, the temperatures of the primary combustion chamber and the secondary combustion chamber are then controlled by adjusting the combustion air flows using valves 140, 121, and 123, and the fuel flow using valve 161.

FIGS. 1 and 2 show the exhaust stack 170 through which a portion of the exhaust gas from the secondary combustion chamber 120 exits. The buoyancy of the exhaust gas in the stack produces a vacuum within the system 100, resulting in the combustion air entering the system 100 and the exhaust flow exiting the stack 170. As shown, the stack may include a fan arrangement 172 which assists with the creating the combustion air and exhaust exit flow, show as 210 in FIG. 2. The suction produced by the fan 172 may also be used to draw combustion air into the system 100. It should be noted that the split in the exhaust gas shown at 200*a* and 210 is created on account of pressure differences in that section of the secondary combustion chamber 120 that are created by the eductor 130.

Figure 3:
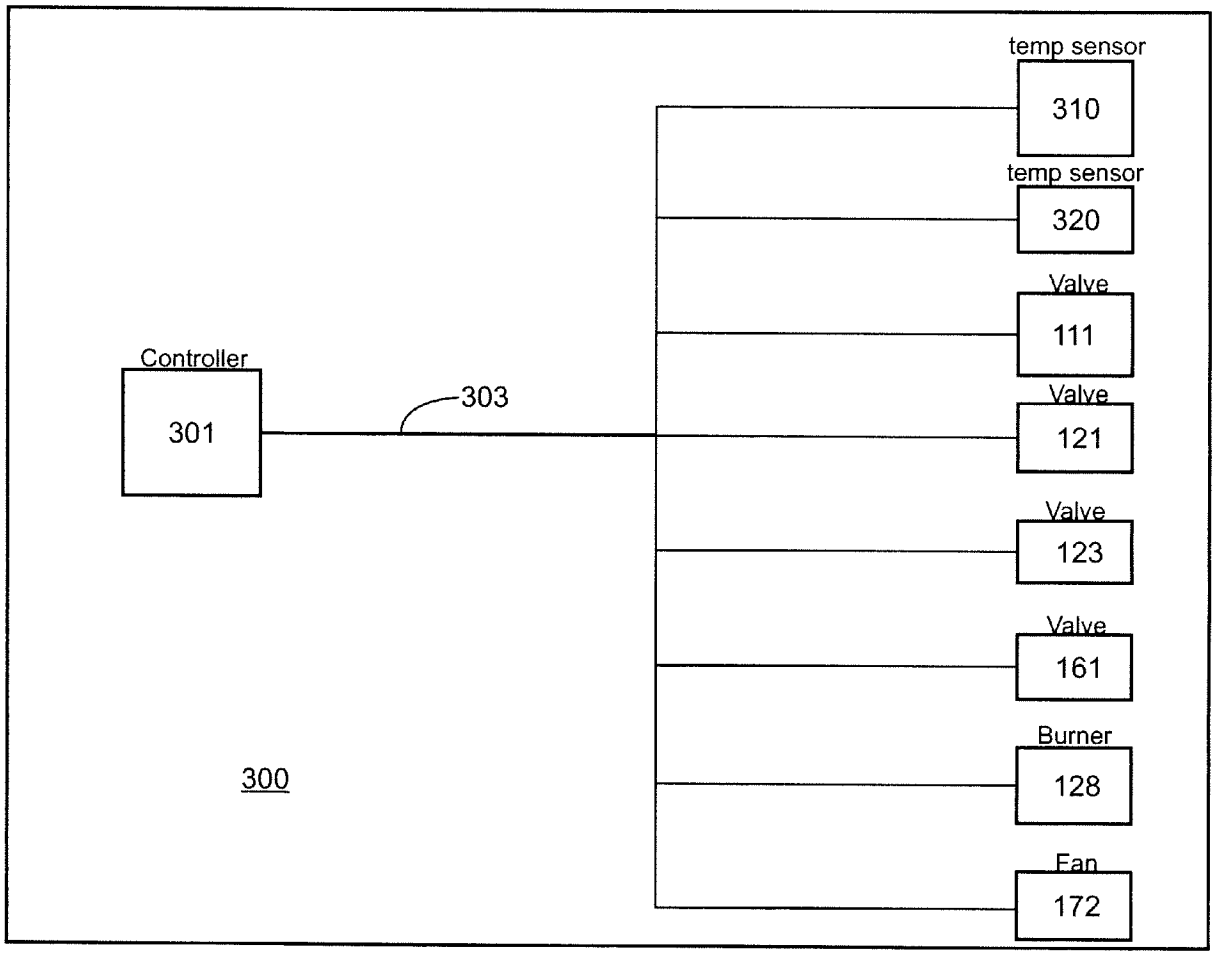
FIG. 3 is an exemplary schematic illustration of the controller arrangement of the eductor based incineration system, according to an embodiment of the invention.

The process outlined above may be controlled via manual operation, computer operation or a combination thereof. FIG. 3 is an exemplary schematic illustration of the controller system 300 of the two-chamber incineration system 100, according to an embodiment of the invention. The FIG. 3 illustration outlines primarily a computer controlled arrangement. The controller system 300 includes a controller 301 which may be a non-transitory computer-readable medium storing an information processing program that causes an associated computer to execute operations, some of these operations based on signals received from different sensors placed throughout the system 100.

As shown the controller arrangement 300 includes a controller 301, which interfaces with a first temperature sensor arrangement 310 which is located in the primary combustion chamber 110. The controller 301 also interfaces with a second temperature sensor arrangement 320, which is located in the secondary combustion chamber 120. The temperature sensor arrangements 310 and 320 may each include one temperature sensor or may include multiple temperature sensors. The temperature sensors may any known sensor such as thermocouples, thermistors, resistance thermometers, or the like. The controller 301 also interfaces with the valves 111, 121, 123, and 161 as shown. The valves 111, 121, 123, and 161 may be any known valve, such as reed butterfly, gate, globe valves or the like. As shown the controller 301 may also interface with the burner 128 inside the secondary combustion chamber 120 (or alternatively within the eductor 130) and the fan 172 at the exhaust stack 170. FIG. 3 shows the controller 301 connected to the constituent elements of the arrangement 300 via an input/output bus 303, and the connection may be wired or wireless. Although not illustrated, the arrangement 300 may include other sensors, such as flow and pressure sensors, connected to the controller 301, for providing other control operations.

As stated above, the controller 301 may be used to control the operation of the two-chamber combustion system 100. Thus, at the beginning of the operation the controller may signal the opening of the bypass combustion air valve 123 to allow bypass combustion air into the secondary combustion chamber 120, and also signal the opening of the fuel valve 161 to direct the flow of fuel into the secondary combustion chamber 120. The controller may also ignite the fuel at burner128, to burn the fuel in the combustion air, and to heat the secondary combustion chamber 120 to a predetermined preheat temperature, which may be about 1800 to about 2000 degrees Fahrenheit. The controller 301 also monitors the temperature readings within the secondary combustion chamber 120, via signals from the temperature sensor arrangement 320. Based on the temperature readings, the controller 301 determines if the predetermined preheat temperature has been reached.

When the controller 301 determines that the predetermined preheat temperature is reached, the controller executes several follow-up steps to continue the combustion process. These steps include the closing of the bypass combustion air valve 123 to stop the flow of combustion air from the bypass combustion air supply. The controller 301 may also partially close the fuel valve to reduce the flow of fuel into the secondary combustion chamber in order to maintain the temperature in the secondary combustion chamber 120 at a temperature that is substantially within the predetermined preheat temperature range of about 1,800-2,000 degrees Fahrenheit. The controller 301 then opens the secondary combustion air valve 121 to allow secondary combustion air into the secondary combustion chamber 120 via the eductor 130, wherein a pressure difference is created across the eductor 130 that generates a recirculating flow 200 (200*a*, 200*b*, 200*c*, 200*d*) between the primary combustion chamber 110 and the secondary combustion chamber 120. The formation of this flow 200 has been outlined above, with respect to the description of FIGS. 1 and 2. Additionally, as outlined with respect to FIGS. 1, 2, and 3, based on temperature readings from temperature sensor arrangements 310 and 320, the controller 301 may adjust fuel and/or combustion air flow into the chambers 110 and 120, in order to maintain the temperature at a desired level, and to maintain combustion throughout the system.

As stated above, when the temperature of the primary chamber reaches its set point (approximately 1600 degrees Fahrenheit), the exhaust flow 200*b* is no longer required. When this happens, the controller 301 opens the combustion air bypass valve 123 and closes the combustion air valve 121, causing the combustion air to enter via conduit 124, bypass the eductor, eliminate the pressure rise in the eductor, and stop the recirculating exhaust flow 200. After both chambers have reached their operating temperatures, the controller 301 controls the temperatures of the primary combustion chamber 110 and the secondary combustion chamber 120 by adjusting the combustion air flows using valves 140, 121, and 123, and the fuel flow using valve 161. This prevents the overheating of the primary combustion chamber 110.

According to an embodiment, the invention also includes a method of waste combustion, which has been outlined above in the written description as it pertains to FIGS. 1, 2, and 3. The method includes the providing of the apparatus illustrated in FIG. 1, and providing the waste within the primary combustion chamber 110. The method additionally includes the combustion of the waste in the primary chamber 110 by igniting fuel in the secondary chamber 120 using the burner 128 located in the secondary chamber. The method includes the creating of the recirculation flow 200 the exhaust flow 210, and the control of the system 100.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A two-chamber incinerator system comprising:

a primary combustion chamber having a combustion bed for receiving waste therewithin;

a primary combustion air source connected to the primary combustion chamber providing a primary combustion air supply into the primary combustion chamber;

a secondary combustion chamber, downstream of the primary combustion chamber;

an eductor attached to an inlet region of the secondary combustion chamber;

a supplemental fuel source connected to the eductor providing fuel into the secondary combustion chamber;

a secondary combustion air source connected to the secondary combustion chamber providing a secondary combustion air supply into the secondary combustion chamber;

a burner in the eductor for igniting the fuel in the secondary chamber;

an exhaust fuel-gas conduit, connecting the primary combustion chamber to the eductor, the exhaust fuel-gas conduit feeding fuel-gas from the primary combustion chamber to the secondary combustion chamber;

an exhaust gas recirculation conduit, connecting the secondary combustion chamber to the primary combustion chamber, wherein the exhaust gas recirculation conduit feeds exhaust gas from the secondary combustion chamber to the primary combustion chamber, the exhaust gas, in combination with the primary combustion air, igniting the waste within the primary combustion chamber, wherein the fuel-gas conduit and the exhaust gas recirculation conduit form a recirculation loop between the primary combustion chamber and the secondary combustion chamber; and a bypass combustion air conduit for supplying the secondary combustion air from the secondary combustion air source directly into the secondary combustion chamber.

2. The incinerator system of claim 1 further comprising an exhaust stack connected to the secondary combustion chamber for evacuating a portion of the exhaust gas from the system, and for drawing combustion air into the system.

3. The incinerator system of claim 2 further comprising:

a first temperature sensor arrangement in the primary combustion chamber;

a second temperature sensor arrangement in the secondary combustion chamber;

a fuel valve for regulating the flow of fuel into the secondary combustion chamber;

a secondary combustion air valve for regulating the flow of the secondary combustion air into the secondary combustion chamber via the eductor;

a bypass combustion air valve for regulating the flow of secondary combustion air directly into the secondary combustion chamber;

a primary combustion air valve for regulating the flow of the primary combustion air into the primary combustion chamber;

a controller, electrically connected to the first and second temperature sensor arrangements, the fuel valve, the secondary combustion air valve, the bypass combustion air valve, the primary combustion air valve, and the burner for controlling the operation of the incinerator system.

4. The incinerator system of claim 3, wherein the controller comprises a non-transitory computer-readable medium storing an information processing program that causes a computer to execute operations comprising:

opening the bypass combustion air valve to allow bypass combustion air into the secondary combustion chamber;

opening the fuel valve to direct the flow of fuel into the secondary combustion chamber;

igniting the burner to burn the fuel and to heat the secondary combustion chamber to a desired temperature; and monitoring the temperature readings within the secondary combustion chamber to determine if a predetermined preheat temperature is reached.

5. The incinerator system of claim 4, wherein when the predetermined preheat temperature is reached, the information processing program causes the computer to execute operations comprising:

closing the bypass combustion air valve to stop the flow of combustion air from the bypass combustion air supply;

partially closing the fuel valve to reduce the flow of fuel into the secondary combustion chamber in order to maintain the temperature in the secondary combustion chamber at a temperature that is substantially equal to the predetermined preheat temperature;

opening the secondary combustion air valve to allow secondary combustion air into the secondary combustion chamber via the eductor, wherein a pressure difference is created across the secondary combustion chamber generates a recirculating flow between the primary combustion chamber and the secondary combustion chamber, wherein the recirculating flow comprises:

the exhaust that flows from the secondary combustion chamber to the primary combustion chamber; and the fuel gas generated from the ignited waste in the primary chamber that flows from primary chamber into the secondary chamber via the eductor.

6. The incinerator system of claim 5, wherein when the primary chamber reaches its operating temperature, the information processing program causes the computer to execute operations of closing the combustion air valve and opening the combustion air bypass valve to stop the recirculation flow to avoid overheating the primary chamber.

7. A method of waste combustion comprising:

providing a primary combustion chamber having a combustion bed for receiving waste therewithin;

providing waste on the combustion bed;

providing a primary combustion air source connected to the primary combustion chamber providing a primary combustion air supply into the primary combustion chamber;

providing a secondary combustion chamber, downstream of the primary combustion chamber;

providing an eductor attached to an inlet region of the secondary combustion chamber;

providing a supplemental fuel source connected to the eductor providing fuel into the secondary combustion chamber;

providing a secondary combustion air source connected to the eductor providing a secondary combustion air supply into the secondary combustion chamber;

providing a burner in the eductor for igniting the fuel;

providing an exhaust fuel-gas conduit, connecting the primary combustion chamber to the eductor;

providing an exhaust gas conduit, connecting the secondary combustion chamber to the primary combustion chamber providing a bypass combustion air conduit for supplying the secondary combustion air from the secondary combustion air source directly into the secondary combustion chamber;

the method further comprising;

feeding combustion air from the secondary combustion air source into the secondary combustion;

feeding fuel into the secondary combustion chamber;

igniting the burner to burn the fuel thereby creating an exhaust gas byproduct within the secondary combustion chamber;

directing the exhaust gas to the primary combustion chamber via the exhaust gas conduit, and using the exhaust gas waste in combination with the primary combustion air supply to ignite the waste within the combustion bed.

8. The method of waste combustion of claim 7, wherein the combustion air is fed from the secondary combustion air source into the secondary combustion chamber via the eductor, and wherein a pressure difference is created across the eductor generating a recirculating flow between the primary combustion chamber and the secondary combustion chamber, wherein the recirculating flow comprises:

the exhaust that flows from the secondary combustion chamber to the primary combustion chamber; and a fuel gas generated from the ignited waste in the primary chamber flowing from primary chamber into the secondary chamber via the eductor.

9. The method of waste combustion of claim 8, wherein prior to generating the recirculating flow, the combustion air is fed through the bypass combustion air conduit into the secondary combustion chamber, the method further comprising monitoring the temperature within the secondary combustion chamber to determine if a predetermined preheat temperature is reached, and wherein when the predetermined preheat temperature is reached, the method further comprising:

reducing the flow of fuel into the secondary combustion chamber in order to maintain the secondary combustion chamber temperature at about the predetermined preheat temperature.

10. The method of waste combustion of claim 8, wherein when the primary chamber reaches its operating temperature, the method further comprises closing the combustion air valve and opening the combustion air bypass valve to stop the recirculation flow to avoid overheating the primary chamber.

* * * * *